US005967225A

United States Patent [19]

Jenkins

[11] Patent Number: 5,967,225

[45] Date of Patent: Oct. 19, 1999

[54] BODY HEATING/COOLING APPARATUS

[76] Inventor: Donny Ray Jenkins, 72 Roper Ct., N. Augusta, S.C. 29832

[21] Appl. No.: 09/007,924

[22] Filed: Jan. 16, 1998

[51] Int. Cl.[6] ..... F28F 7/00

[52] U.S. Cl. ..... 165/46; 165/41; 165/104.14; 165/104.31; 165/145; 165/132; 165/140; 165/163; 62/259.3

[58] Field of Search ..... 165/46, 41, 104.14, 165/120, 104.19, 104.28, 140, 122, 163, 104.25, 145, 104.31, 132; 62/259.3

[56] References Cited

U.S. PATENT DOCUMENTS

| | | | |
|---|---|---|---|
| 3,406,678 | 10/1968 | Hanks | 165/46 |
| 4,691,762 | 9/1987 | Elkins et al. | 165/46 |
| 5,201,365 | 4/1993 | Siegel | 165/46 |
| 5,320,164 | 6/1994 | Szczesuil et al. | 165/46 |
| 5,433,083 | 7/1995 | Kuramarohit | 165/46 X |

FOREIGN PATENT DOCUMENTS

| | | | |
|---|---|---|---|
| 0140595 | 5/1990 | Japan | 165/104.14 |

*Primary Examiner*—Christopher Atkinson
*Attorney, Agent, or Firm*—Bernstein & Associates

[57] ABSTRACT

A body heating/cooling apparatus comprising an enclosure (10) for raising or lowering the temperature of a fluid (22) prior to circulating the fluid (22) through a vest (55). The enclosure (10) has a first chamber (13) where the fluid (22) returning from the vest (55) is picked up by a pump (25) and recirculated through a second chamber (16). The vest (55) has an integrally formed channel (67) that passes through the vest (55) in serpentine fashion. The enclosure (10) may also be equipped with a module for also providing helmet cooling for racing car applications.

21 Claims, 6 Drawing Sheets

BODY HEATING/COOLING APPARATUS

FIELD OF THE INVENTION

The present invention generally pertains to apparatus for external heating or cooling of the body, and specifically pertains to a body cooling apparatus for use inside a racecar.

BACKGROUND OF THE INVENTION

During racing competitions held in warmer climates or during the summer months the temperatures inside the racing vehicles can become very high. The heat from the engine, the other cars, and the racetrack surface has a cumulative effect on the temperature inside the vehicle and may expose the driver to extreme temperatures during the course of a race.

There are many physical problems that may result from prolonged exposure to heat including heat exhaustion, heat stroke, and dehydration. For most racing applications there are existing devices for cooling the driver's helmet during the race. There have also been attempts at providing articles of clothing for cooling the body of the driver during the race. The previous methods for cooling the body under race conditions have not been accepted for several reasons including the complexity of the systems and the discomfort associated with use of the systems particularly over an extended period of time.

When adding a cooling system to a car designed for competition, the most important factors are weight and electrical power requirements. Both of these factors can reduce the horsepower output from the engine. Accordingly, the decision to add weight or to increase the electrical load must be considered carefully. Extra weight slows down the vehicle, and extra consumption of power requires more of the horsepower from the engine to be used for electrical power requirements.

What is needed is a body cooling system that requires a minimum of electrical current, that adds a minimum of extra weight to the vehicle, that is safe and reliable, and that comfortably cools the body of a driver during a race.

SUMMARY OF THE INVENTION

Generally described, the present invention provides a cooling apparatus for cooling the body which operates by circulating a cooling fluid through a vest worn by the user.

In a preferred embodiment, the present invention provides an enclosure having a first chamber disposed inside the enclosure and containing a fluid. The fluid is circulated through the system by a pump disposed inside the first chamber. The pump has an intake port and an outlet for conveying the fluid through tubing. A second chamber is disposed inside the enclosure and contains a cooling medium. The tubing extends from the outlet of the pump and carries the fluid from the pump through the second chamber such that the fluid loses heat while passing through the second chamber. The temperature in the second chamber is much cooler than the initial temperature of the liquid, and the result is cooling of the liquid as it passes through the tubing inside the second chamber.

After the liquid passes through the tubing in the second chamber, the liquid enters a cooling vest that is worn by the driver. The vest has an inlet and an outlet and a cavity disposed therebetween. The inlet of the vest is connected to the first tube such that fluid is capable of flowing from the inlet to the outlet through the cavity. The flow of the cool liquid through the vest worn by the driver has a cooling effect which reduces the effect of the heat encountered during the race. A return tube extends from the outlet of the cooling vest back to the first chamber in the enclosure such that the fluid returns to the first chamber after passing through the cooling vest. Once the fluid is back in the first chamber it goes into the pump and recirculates through the system.

In an alternate embodiment the apparatus described above is combined with an apparatus for providing cool air to the helmet of the driver. The additional apparatus requires four additional chambers inside the enclosure. A third chamber (the first and second chamber are part of the apparatus described above) has a cooling medium and an inlet and an outlet. A blower connects to the inlet of the third chamber and forces air through the chamber. A fourth chamber is disposed inside the enclosure adjacent to the third chamber and has a cooling medium inside. A filter is positioned between the between the third chamber and the fourth chamber to remove impurities from the incoming air. A fifth chamber is disposed adjacent to the fourth chamber and has a pressure equalization tube extending from the fourth chamber to the fifth chamber. The air from the blower passes through the third chamber into the fourth chamber. The fourth chamber is connected to a fifth chamber by an opening positioned in a divider between the chambers. The opening is equipped with a filter.

A sixth chamber is disposed adjacent to the fifth chamber and has an outlet with an opening extending to the outside of the enclosure. A dividing wall having a plurality of apertures is positioned between the fifth and sixth chamber.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

The preferred embodiment is described in terms of a cooling apparatus; however, it is not intended to be limited in that way as the system can be routinely modified to provide for heating.

Figure 1:
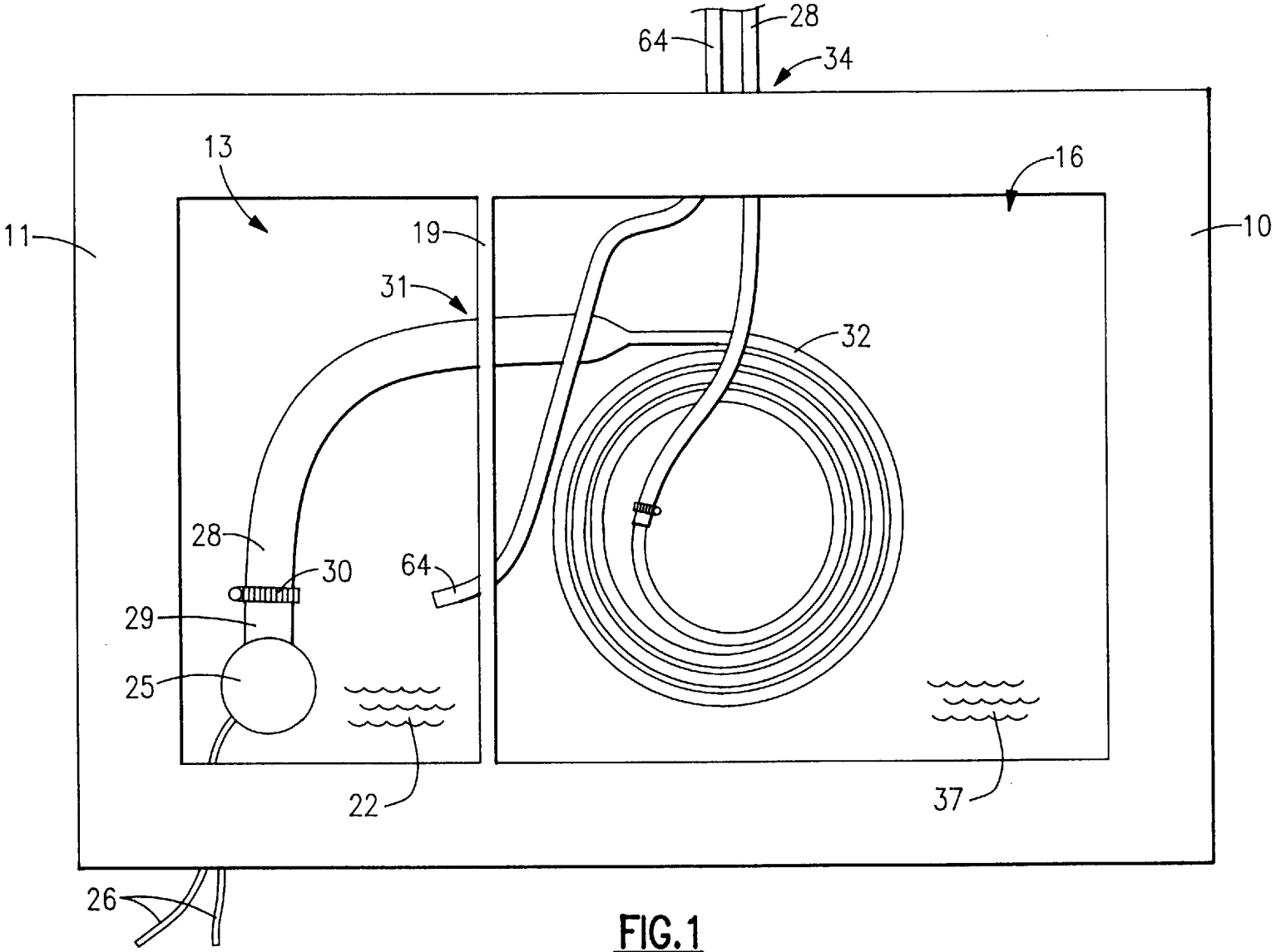
FIG. 1 is a cutaway plan view of the enclosure of the present invention.

Referring to FIG. 1 an enclosure 10 is preferably formed out of a material with insulating properties, such as Styrofoam. The specific type of material is not critical but it should have certain properties such as insulating ability, durability, and the ability to accept a plastic coating on the outside. The enclosure 10 has an outer wall 11 with sufficient thickness to provide insulation. The inside of enclosure 10 is divided into a first hollow chamber 13 and a second hollow chamber 16, which are bordered by a common dividing wall 19. The dividing wall 19 is made of a rigid plastic, but the seal between the two chambers does not have to be airtight. The seal should preferably be liquid tight at the bottom in order to prevent a fluid 22 from passing from the first chamber 13 to the second chamber 16.

The fluid 22 in the first chamber is preferably water but other fluids suitable for circulation through a closed loop cooling system may be substituted. Water is preferred because it is non-toxic.

A pump 25 takes in the fluid 22 and pumps it into a first tube 28. The pump 25 is preferably a submersible bilge-type pump that pumps the water at a pressure of approximately 10 pounds per square inch. The preferred pump 25 is available from ITT Jabsco in Costa Mesa, Calif. under part number 30220-1012, model number 400. The ITT pump is capable of flow rates up to 400 gallons per hour, draws only 2 amps, and can be powered by 12 V DC. A pair of motor wires 26 extend from the pump and can be wired to the DC output of the automobile battery of the car or other DC source. Other pumps can also be suitable as long as they consume a minimum amount of electricity and are capable of generating enough pressure to keep the fluid 22 moving through the system. The tube 28 is preferably a flexible, plastic tubing suitable for plumbing.

Fluid 22 exits the pump 25 and enters the first tube 28 which is typically attached to the output port 29 by a standard band clamp 30. The fluid 22 is then carried by the first tube 28 into the second chamber 16. The first tube 28 extends into the second chamber 16 through an opening 31 in the dividing wall 19. Once the first tube 28 enters the second chamber 16, it preferably transitions from plastic to copper by means of an adapter. Copper is selected because of its thermal conductivity and noncorrosiveness. The copper tubing section 32 of the first tube extends in several loops around the second chamber 16. After the final loop the first tube 28 exits the enclosure 10 through an opening 34. A cooling medium 37 is placed inside the second chamber 16 through an opening, and the cooling medium 37 removes heat from the fluid 22 as it circulates through the first tube 28. The preferred cooling medium 37 is ice because it is inexpensive and non-toxic. However, other cooling media may also be used. In the alternative, the second chamber 16 could be equipped with a heating element (not shown) to provide for heating a fluid to circulate through the vest.

The copper tubing section 32 is constructed of a sufficient length and number of turns to ensure that sufficient cooling occurs while the fluid 22 is circulating through the second chamber 16 in the tube 28.

Figure 2:
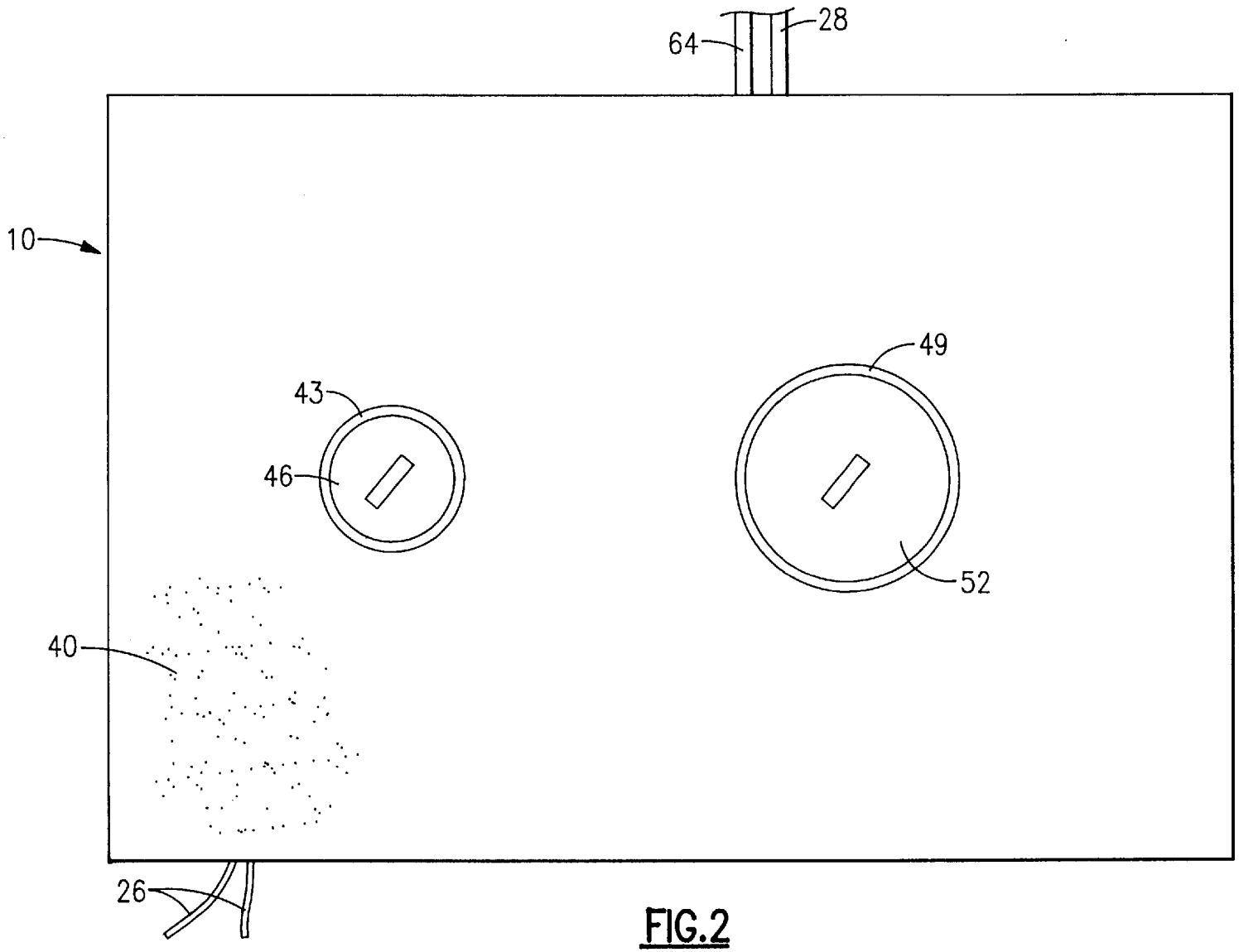
FIG. 2 is a plan view of the enclosure of the present invention.

Turning to FIG. 2, the outside of the enclosure 10 is coated with a hard plastic shell 40 that is preferably sprayed onto it. The plastic coating 40 is sprayed onto the enclosure 10 by the same process and in the same manner as spray-on truck bed liners are formed. The hard plastic shell 40 protects the chambers 13 and 16 from dirt, debris, and damage. The enclosure 10 will normally be filled with ice and water prior to use and the shell 40 protects the unit during transport and storage. Also, the shell 40 functions as an additional insulation barrier.

The enclosure 10 provides easy access for replacing the fluid 22 and the cooling medium 37. A first pipe stub 43 is preferably constructed of two (2) inch o/d PVC pipe and has a removable cap 46 attached to it to provide access for filling the first chamber 13 with water. A second pipe stub 49 is four (4) inch o/d and has a removable cap 52 attached to it. The second pipe stub 49 provides an opening for filling the second chamber 16 with ice. Other pipe sizes known to those skilled in the art are contemplated as being within the scope of the present invention.

Figure 3:
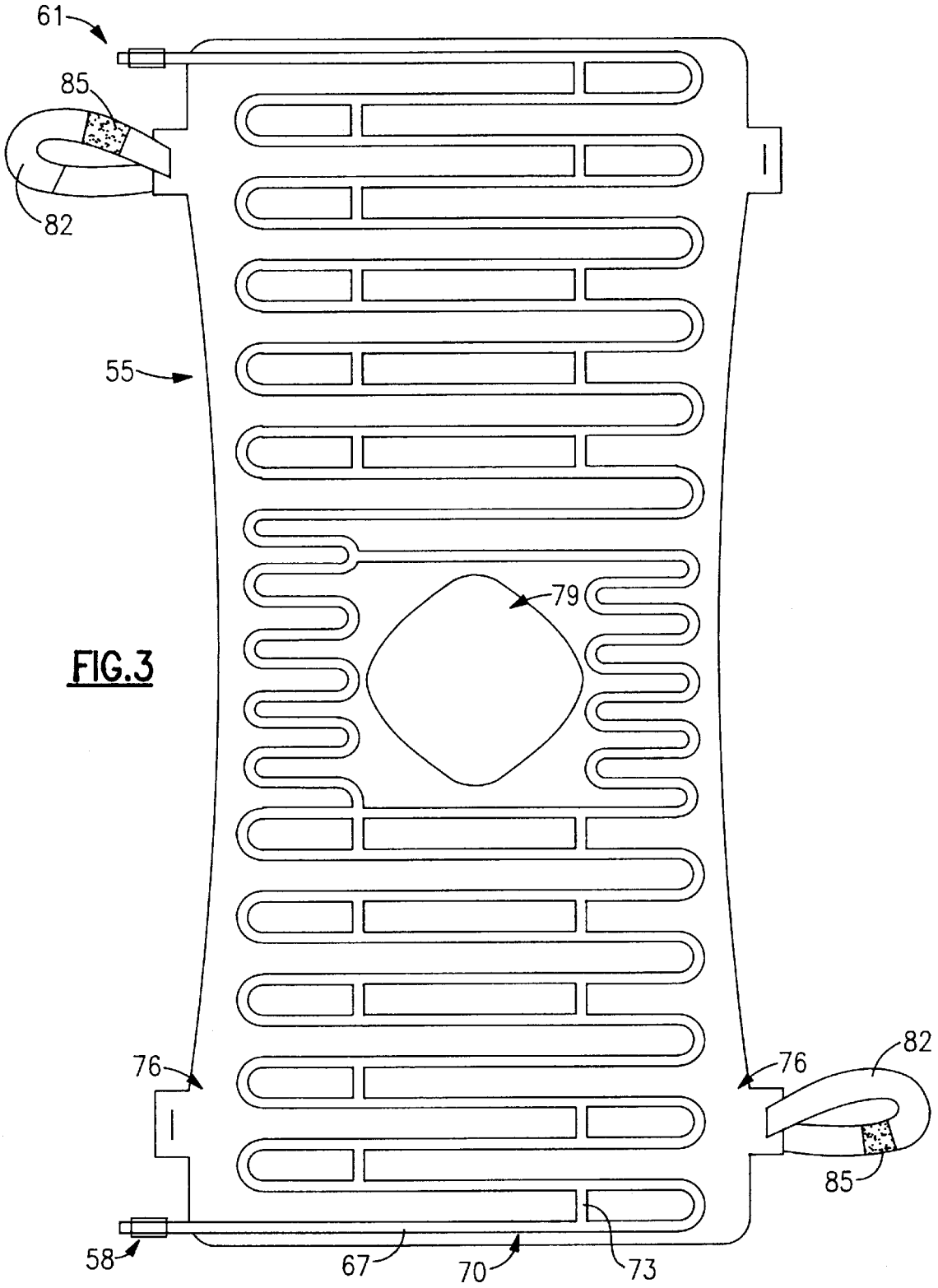
FIG. 3 is a top view of the vest of the present invention.

Turning to FIG. 3, a cooling vest 55 has a pair of quick-connect valves 58 and 61 (known in the art) attached at opposite ends which connect to the first tube 28 and a return line 64 (shown in FIG. 2) by male-female connectors. The vest 55 is formed out of two layers of plastic that are heat sealed with an integrally formed channel 67. The channel 67 enables fluid 22 to pass through the vest 55 and is arranged in serpentine fashion throughout the vest 55. The fluid 22 is continuously pumped through the vest 55 from the input valve 58 to the output valve 61. The serpentine pattern of the channel 67 is formed by a plurality of lengths 70 that wind back and forth throughout the vest 55.

The lengths 70 of channel 67 are connected to one another by a short passageway 73 positioned between the ends 76 of the length of channel 67. The short passageways 73 provide bypasses for the cooling fluid 22 when the main lengths 70 of channel 67 are blocked due to the position of the driver or the position of the vest 55 on the driver. When the channel 67 is not constricted the fluid 22 will pass through the channel 67 only and will not enter the short passageways 73.

The vest 55 has an opening 79 that fits over the head of the driver and the front and back of the vest 55 are attached by straps 82 with hook and loop fasteners 85 attached at the end.

Referring back to FIG. 1, the return line 64 returns fluid 22 from the vest 55 to the first chamber 13. Once the fluid 22 reenters the first chamber 13 it is picked up by the intake of the pump 25 and recirculated through the system.

Figure 4:
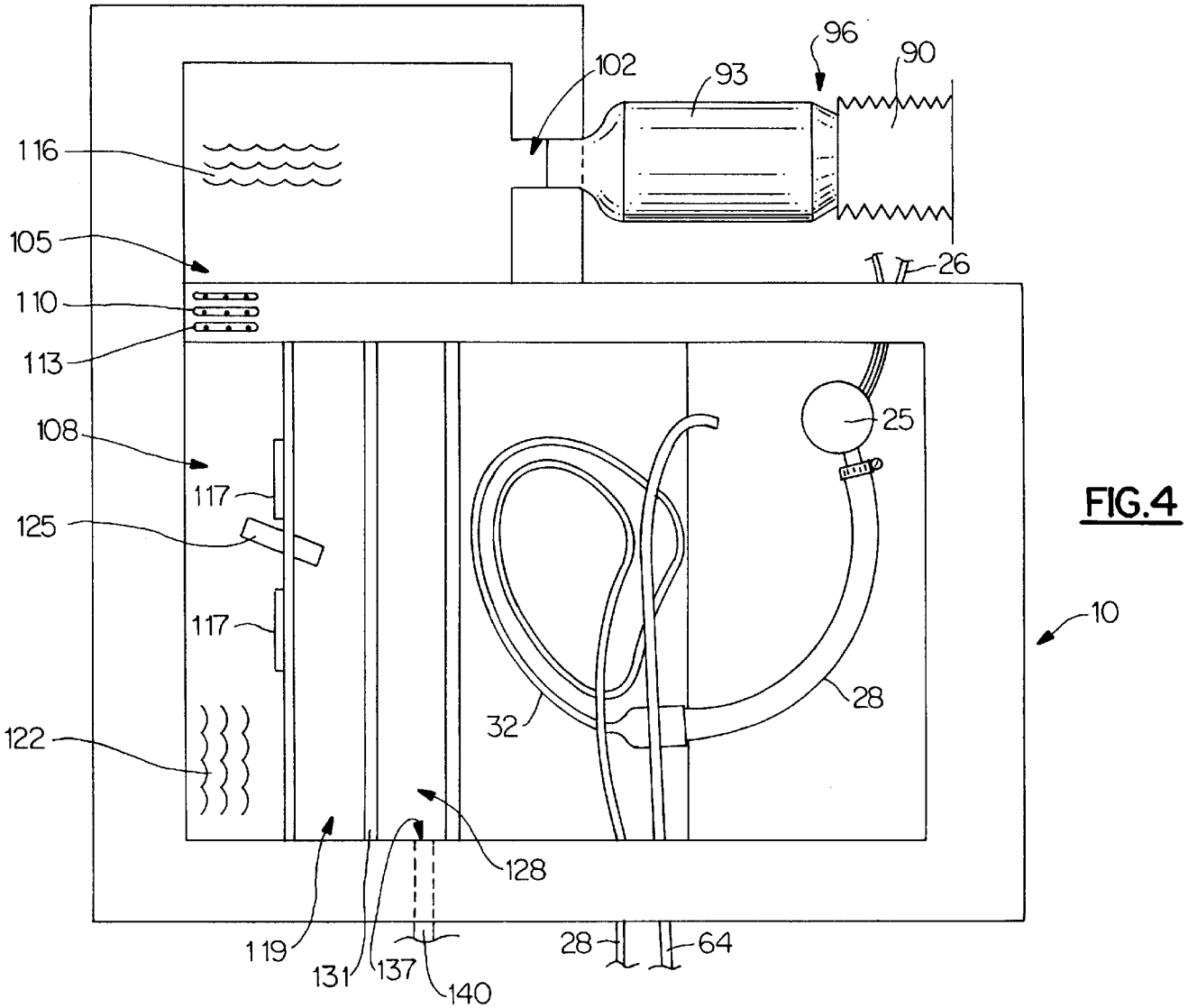
FIG. 4 is a cutaway plan view of an alternate embodiment of the enclosure of the present invention.
Figure 5:
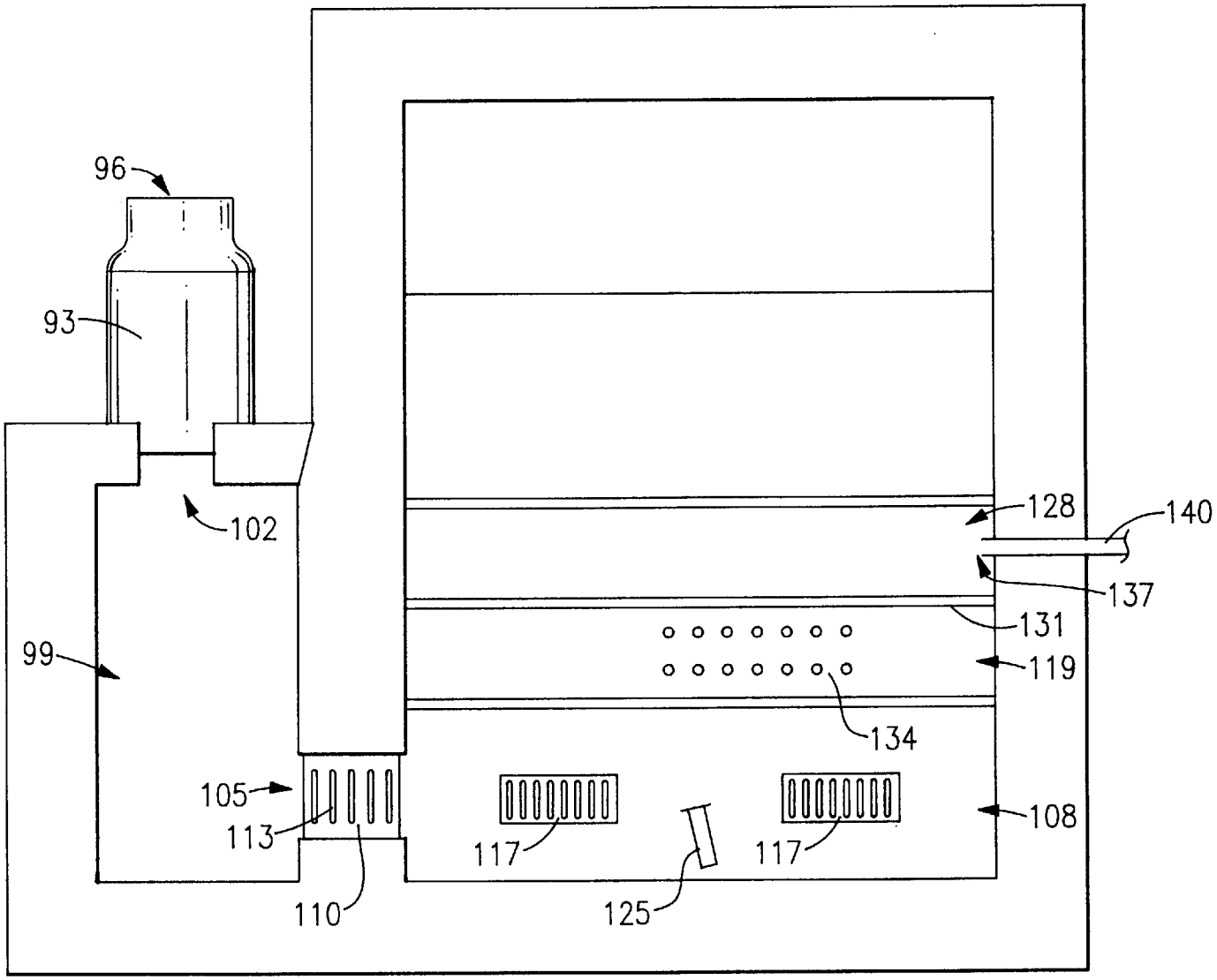
FIG. 5 is a cutaway perspective view of an alternate embodiment of the enclosure of the present invention.

FIGS. 4 and 5 show an alternate embodiment of the present invention. The alternate embodiment includes additional apparatus for cooling the driver's helmet. In order to cool the head and face of the driver air from outside the car is gathered through a vent and conveyed through a tube 90 to a blower 93. The blower 93 produces approximately 230 cubic feet per minute; however, the range of cfm will vary depending on the fan or blower selected and is not critical. The intake air is taken directly from the outside of the car and may contain carbon monoxide and other gases that need to be removed prior to passing the air to the driver. Also, the air from the track is very warm and has to be cooled before it can be conveyed to the helmet.

The tube 90 conveys air from the outside of the car to the intake 96 of the blower 93. The blower 93 conveys the air into a third chamber 99. The third chamber 99 is adapted for mounting the blower 93 to an inlet 102. The third chamber 99 also has an outlet 105 that leads to a fourth chamber 108. A filter 110 is positioned inside the outlet 105 so that air passing from the third chamber 99 to the fourth chamber 108 has to pass through the filter 110. The filter 110 is preferably a cartridge type filter with activated charcoal 113 as the filter element although other filter systems known to those skilled in the art are contemplated as being within the scope of the present invention. The third chamber 99 contains a cooling medium 116 for removing heat from the air as it passes through the chamber. The cooling medium 116 is also preferably ice; however, other cooling media may also be suitable.

Once the air enters the fourth chamber 108 it passes through another set of filters 117 to reach a fifth chamber 119. The fourth chamber 108 also has a cooling medium 122 stored in the chamber to cool the air. A pressure equalization tube 125 extends from the bottom of the fourth chamber 108 to the bottom of the fifth chamber 119. The pressure equalization tube 125 prevents the fourth chamber 108 from building up too much pressure. If the fourth chamber 108 builds up too much pressure, the water from the melting ice will be pressure conveyed into the driver's helmet. By utilizing a pressure equalizing tube 125 the pressure inside the fourth chamber 108 is controlled and air is allowed to pass through the system without picking up the water.

Air passes from the fifth chamber 119 to a sixth chamber 128 through a dividing wall 131. The dividing wall 131 has a set of apertures 134 (shown in FIG. 5) in it which allow air to pass. Air passes through the sixth chamber 128 and exits to the helmet through an outlet 137 that is connected to a tube 140. The tube 140 carries the air to the driver's helmet. The air conveyed to the helmet has been filtered to remove harmful gases and has been cooled and humidified to provide maximum comfort to the driver.

Figure 6:
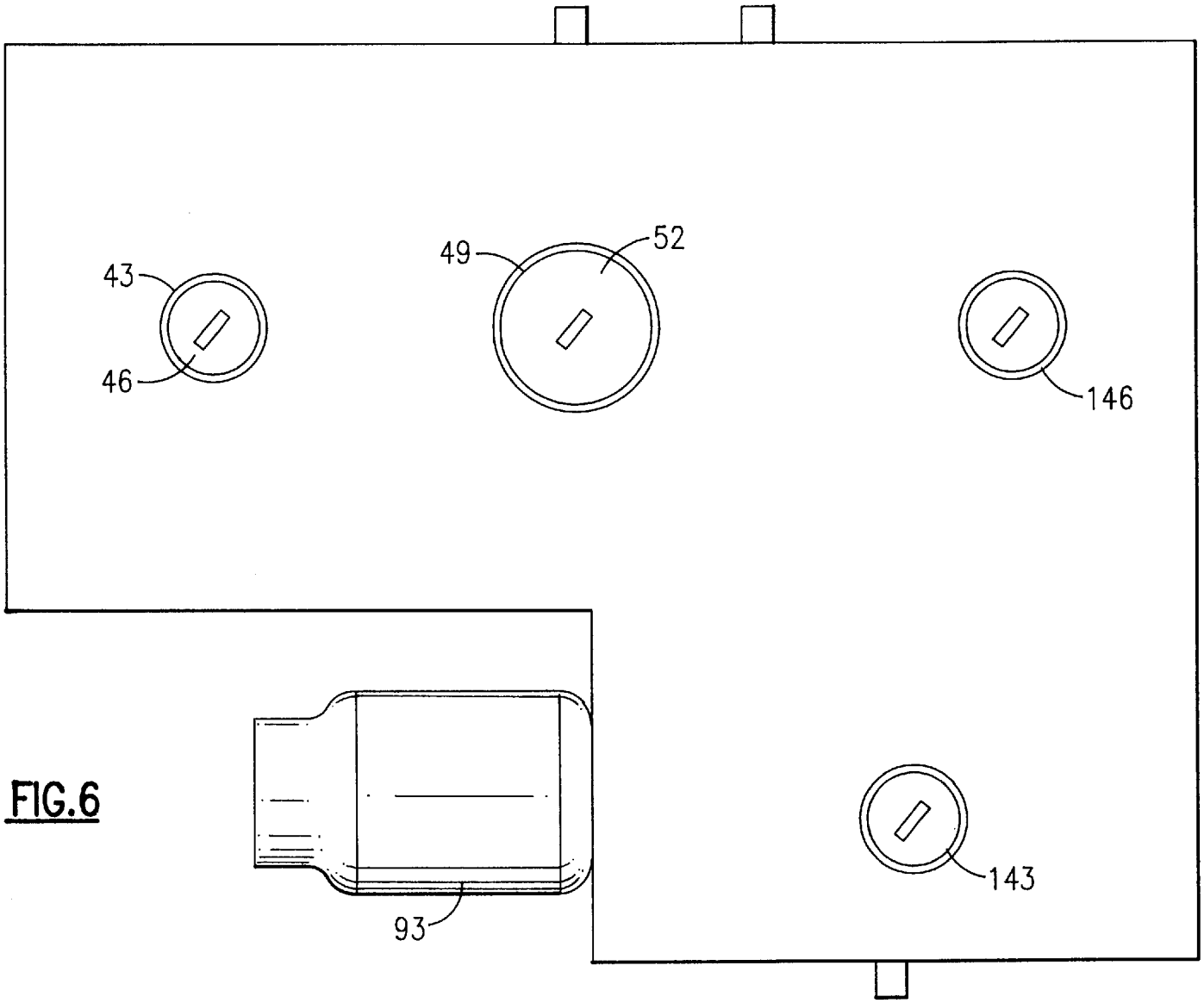
FIG. 6 is a plan view of the enclosure of the alternate embodiment.

In FIG. 6 the enclosure 10 is shown in the alternate embodiment. In addition to the pipe stubs 43 and 49 there are pipe stubs 143 and 146 for inserting ice into the third chamber 99 and the fourth chamber 108.

In operation, the unit is filled with ice and water in the appropriate compartments and then mounted inside a race vehicle. The electrical connection to the automobile battery is preferably made with quick connect plugs and the driver has a manual switch to turn the system on and off. The system operates automatically such that if the battery on the vehicle is cranked and the switch for the cooling apparatus is turned on, the system will run continuously and constantly circulate the fluid 22 through the vest 55.

Accordingly, the present invention offers many advantages, including the ability to efficiently cool the vest and helmet for a driver in a racing competition.

Another advantage of the present invention is that it provides a relatively lightweight system that requires very little electrical power from the vehicle battery.

Yet another advantage is that the system could easily be modified to adapt to an AC power source and be used by a pit crew during a race. The pit crews are also exposed to severe temperatures at a track. Also, the system may be adapted to many other applications where cooling or heating from a vest is desirable.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A body heating/cooling apparatus, comprising:

a) an enclosure;

b) a first chamber disposed inside the enclosure and containing a fluid;

c) a pump disposed inside the first chamber and having an outlet for conveying the fluid;

d) a second chamber disposed inside the enclosure and containing a heat transfer medium;

e) a first tube extending from the outlet of the pump and capable of conveying the fluid from the pump through the second chamber such that heat transfer between the fluid and the heat transfer medium occurs while the fluid passes through the second chamber;

f) a vest having a having an inlet and an outlet and a cavity disposed therebetween, the inlet connected to the first tube such that fluid is capable of flowing from the inlet in the vest to the outlet in the vest through the cavity;

g) a return tube extending from the outlet of the vest to the first chamber such that the fluid returns to the first chamber after passing through the vest;

h) a third chamber having a heat transfer medium therein, the third chamber disposed inside the enclosure and having an inlet and an outlet;

i) a blower having an outlet capable of engaging with the inlet to the third chamber;

j) a fourth chamber disposed inside the enclosure adjacent to the third chamber and having a heat transfer medium disposed therein;

k) a filter disposed between the third chamber and the fourth chamber;

l) a fifth chamber disposed adjacent to the fourth chamber;

m) a pressure equalization tube extending from the fourth chamber to the fifth chamber;

n) at least one filter covering an opening between the fourth chamber and the fifth chamber;

o) a sixth chamber disposed adjacent to the fifth chamber and having an outlet with an opening extending to the outside of the enclosure; and, p) a dividing wall having a plurality of apertures and disposed between the fifth and sixth chamber.

2. The apparatus of claim 1, wherein the enclosure is formed of an insulating material.

3. The apparatus of claim 2, wherein the enclosure is coated.

4. The apparatus of claim 3, wherein the enclosure is coated with a plastic material.

5. The apparatus of claim 1, wherein the pump is electrically operated.

6. The apparatus of claim 5, wherein the pump is capable of being supplied operating power from an automobile battery.

7. The apparatus of claim 1, wherein the first tube has a section formed out of copper.

8. The apparatus of claim 1, wherein the cavity in the vest is formed into a channel.

9. The apparatus of claim 8, wherein the channel is formed out of a plurality of lengths of a continuous channel disposed in serpentine fashion throughout the vest, the plurality of lengths of channel being connected to one another by a short passageway disposed between the ends of the length of channel.

10. The apparatus of claim 9, wherein the channel is formed between two layers of heat sealed plastic material.

11. A body heating/cooling apparatus, comprising:

a) an enclosure;

b) a first chamber disposed inside the enclosure and containing a fluid;

c) a pump disposed inside the first chamber and having an outlet for conveying the fluid;

d) a second chamber disposed inside the enclosure and containing a heat transfer medium;

e) a first tube extending from the outlet of the pump and capable of conveying the fluid from the pump through the second chamber such that heat transfer between the fluid and the heat transfer medium occurs while the fluid passes through the second chamber;

f) a vest having an inlet, an outlet, and a cavity disposed therebetween, the cavity created by a plurality of lengths of a continuous integrally formed channel disposed in serpentine fashion throughout the vest, the plurality of lengths of channel being connected to one another by short passageways disposed between the ends of the lengths of channel, the inlet connected to the first tube such that fluid is capable of flowing from the inlet of the vest to the outlet of the vest through the cavity; and, g) a return tube extending from the outlet of the vest to the first chamber such that the fluid returns to the first chamber after passing through the vest.

12. The apparatus of claim 11, wherein the enclosure is coated with a plastic material.

13. The apparatus of claim 11, wherein the channel is formed between two layers of heat-sealed plastic material.

14. A body heating/cooling apparatus, comprising:

a) an enclosure capable of containing a fluid;

b) a pump disposed inside the enclosure for conveying the fluid, the pump having an inlet and an outlet;

c) a first tube extending from the outlet of the pump;

d) a vest having an inlet, an outlet, and a cavity disposed therebetween, the cavity created by a plurality of lengths of a continuous integrally formed channel disposed in serpentine fashion throughout the vest, the plurality of lengths of channel being connected to one another by short passageways disposed between the ends of the lengths of channel, the inlet of the vest connected to the first tube such that fluid is capable of flowing from the inlet of the vest through the cavity and through the outlet of the vest; and e) a return tube extending from the outlet of the vest to the inlet of the pump.

15. The apparatus of claim 14, wherein the enclosure is formed of an insulating material.

16. The apparatus of claim 15, wherein the enclosure is coated.

17. The apparatus of claim 16, wherein the enclosure is coated with a plastic material.

18. The apparatus of claim 14, wherein the pump is electrically operated.

19. The apparatus of claim 18, wherein the pump is capable of being supplied operating power from an automobile battery.

20. The apparatus of claim 14, wherein the first tube has a section formed out of copper.

21. The apparatus of claim 14, wherein the channel is formed between two layers of heat-sealed plastic material.

* * * * *